US006559578B1

(12) United States Patent
Herden et al.

(10) Patent No.: US 6,559,578 B1
(45) Date of Patent: May 6, 2003

(54) SPARK PLUG FOR AN INTERNAL COMBUSTION ENGINE

(75) Inventors: Werner Herden, Gerlingen (DE); Rudolf Pollner, Bamberg (DE); Thomas Brinz, Sindelfingen (DE); Ulrich Eisele, Stuttgart (DE); Andreas Niegel, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/509,117

(22) PCT Filed: May 5, 1999

(86) PCT No.: PCT/DE99/01344

§ 371 (c)(1),
(2), (4) Date: Mar. 20, 2000

(87) PCT Pub. No.: WO00/07270

PCT Pub. Date: Feb. 10, 2000

(30) Foreign Application Priority Data

Jul. 24, 1998 (DE) ..... 198 33 316

(51) Int. Cl.[7] ..... H01T 13/20; H01T 13/00; H01J 23/16

(52) U.S. Cl. ..... 313/136; 313/118; 313/123; 313/141; 313/143; 315/53; 315/58

(58) Field of Search ..... 313/118, 123, 313/136, 141–146; 315/53, 58

(56) References Cited

U.S. PATENT DOCUMENTS

| | | | | | |
|---|---|---|---|---|---|
| 3,882,341 | A | * | 5/1975 | Green | 123/633 |
| 3,883,776 | A | * | 5/1975 | Berry | 313/118 |
| 4,029,990 | A | * | 6/1977 | Nagy et al. | 313/124 |
| 4,112,330 | A | * | 9/1978 | Stimson et al. | 313/118 |
| 4,224,554 | A | * | 9/1980 | Nishio et al. | 123/633 |
| 4,613,789 | A | * | 9/1986 | Herden et al. | 313/123 |
| 5,095,242 | A | * | 3/1992 | Richeson | 313/136 |
| 5,952,770 | A | * | 9/1999 | Mueller et al. | 313/136 |
| 6,380,664 | B1 | * | 4/2002 | Pollner | 313/118 |

FOREIGN PATENT DOCUMENTS

| | | |
|---|---|---|
| DE | 10 13 924 | 8/1957 |
| DE | 19 65 294 | 7/1971 |
| DE | 44 31 143 | 3/1996 |
| DE | 196 23 989 | 1/1998 |
| FR | 1 302 146 | 12/1962 |

* cited by examiner

*Primary Examiner*—Vip Patel
*Assistant Examiner*—Sikha Roy
(74) *Attorney, Agent, or Firm*—Kenyon & Kenyon

(57) ABSTRACT

A spark plug having a tubular metallic housing has an internal conductor arrangement including a refractory erosion. The refractory erosion resistor is designed either as a wound wire resistor or a filament-like thin-layer resistor.

4 Claims, 3 Drawing Sheets

SPARK PLUG FOR AN INTERNAL COMBUSTION ENGINE

BACKGROUND INFORMATION

German Patent Application No. 196 23 989 describes a spark plug having a tubular metal housing, in which an insulator, with a rod-shaped internal conductor arrangement mounted in it, is embedded. The internal conductor arrangement described herein includes a terminal stud, a current-limiting resistor, a coated contact pin, and a nail-shaped central platinum electrode. The erosion resistor includes a conductive material, which is usually introduced into the insulator as a cast compound. Furthermore, at least two, preferably four, ground electrodes, bent toward the central electrode, are attached to the housing.

SUMMARY OF THE INVENTION

The spark plug according to the present invention has the advantage that, by changing the erosion resistor so that electrically conductive windings form the erosion resistor on an insulating ceramic support, cylinder capacitance is reduced. With a reduced cylinder capacitance the danger of pitting in the insulator is diminished, since energy conversion at the time of spark breakthrough is reduced due to the diminished spark plug.

DETAILED DESCRIPTION

German Patent No. 196 23 989 or German Patent No. 44 31 143, for example, so that it will not be described here again.

Figure 1:
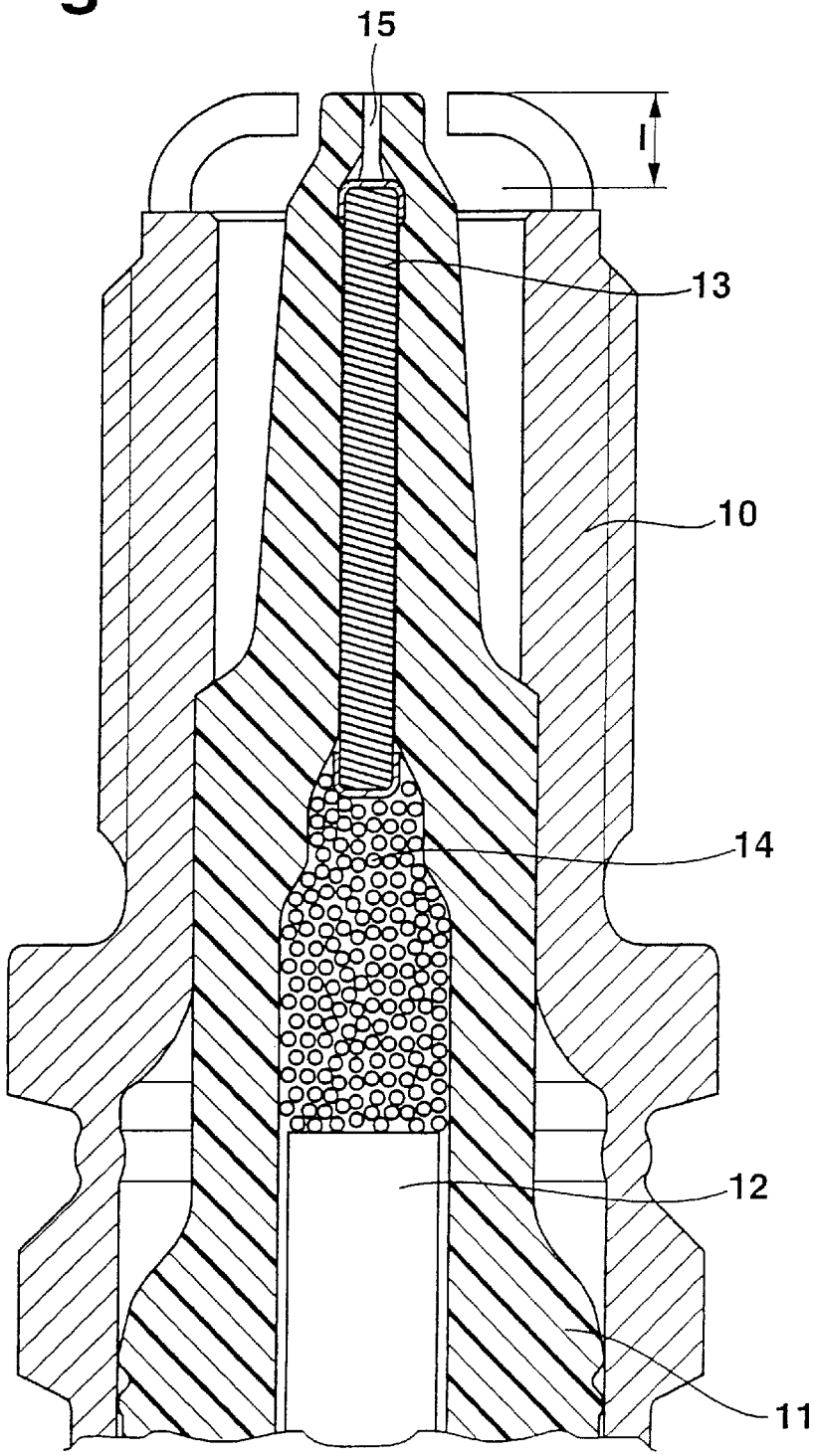
FIG. 1 shows the combustion chamber side end of the spark plug according to the present invention with the resistor pack shown in a section view.
Figure 3:
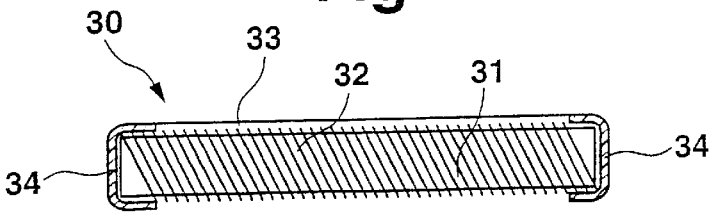
FIG. 3 shows the wound wire resistor.

FIG. 1 shows the combustion chamber side end of a first embodiment having an improved spark plug capacitance. An insulator 11 is arranged in a metallic tubular housing 10, the rotation symmetric axes of housing 10 and insulator 11 being co-incident. Contact studs 12, an erosion resistor 13, a conductive contact 14 and a central electrode 15 are embedded in insulator 11. Erosion resistor 13 is a refractory resistor, whose structure is shown in FIG. 3. The central electrode is formed by a platinum rod here, which absorbs relatively little heat from the combustion chamber due to its small end face. As a result, no substantial amounts of heat are removed through the internal conductor arrangement, so that with this type of spark plug the heat-conductive metallic contact pin can be replaced with a poorly conductive preferred erosion resistor. FIG. 3 shows the refractory resistor as a wound wire resistor 30, where a wire resistor 32 is wound onto an essentially cylindrical ceramic support 31 and subsequently insulated by a glass cover 33. Metal caps 34, which allow the erosion resistor to be electrically contacted, are arranged on both ends of cylindrical ceramic support 31. Glass covering 33 is applied to avoid oxidation processes at high temperatures and to secure the windings. The glass is baked on under protective gas or in vacuum.

Figure 2:
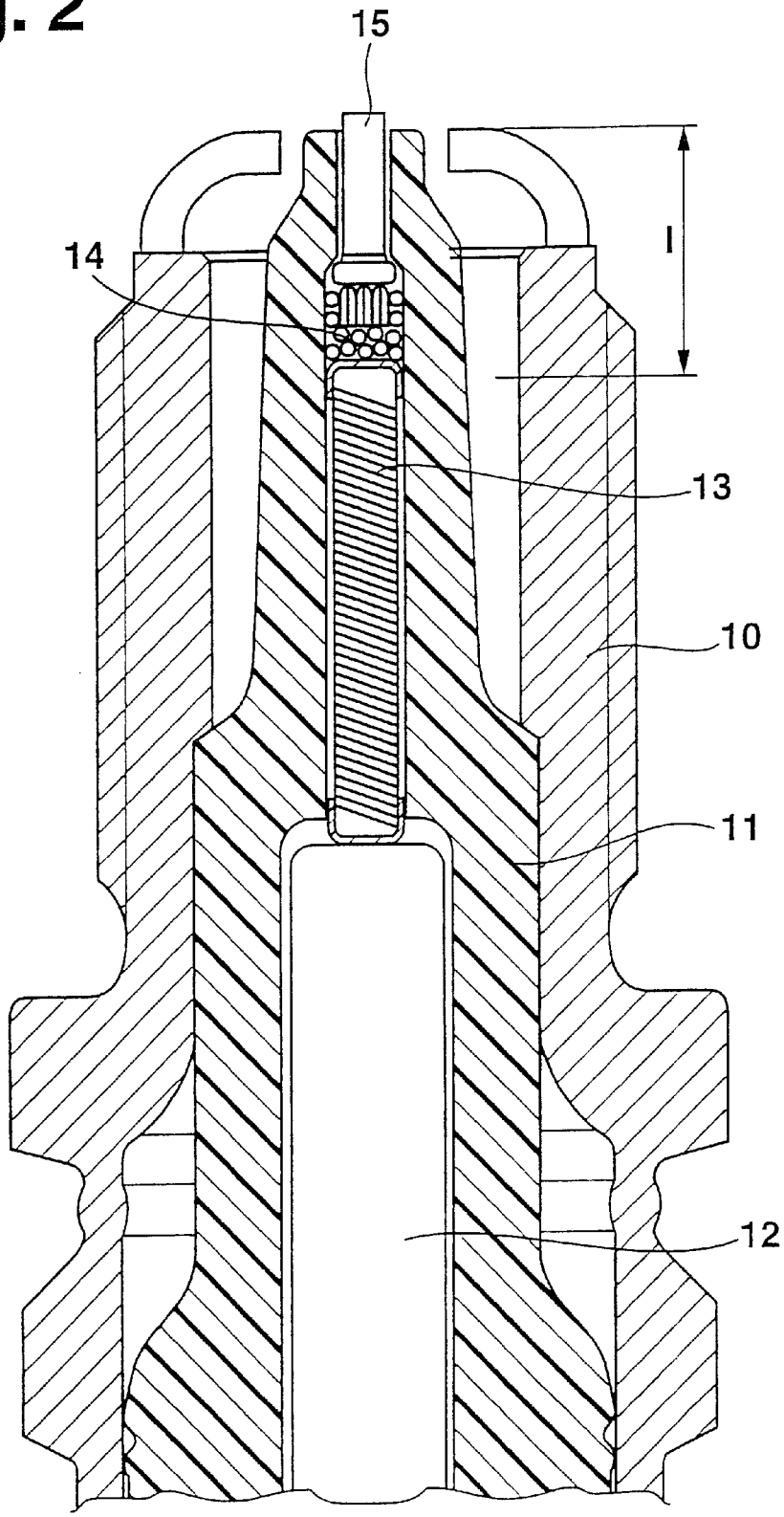
FIG. 2 shows a second embodiment of the combustion chamber side spark plug in a section view.

FIG. 2 also shows a combustion chamber side section of a spark plug having the same basic design features as that of FIG. 1, so that the same components are provided with the same reference symbols. Unlike in FIG. 1, erosion resistor 13 is formed as a thin-layer resistor wound on a ceramic support. The design and mode of operation of this resistor as a wound thin-layer resistor will be elucidated in conjunction with FIG. 4. The central electrode in this second embodiment includes a cold-mounted thick central electrode. Such a central electrode, contrary to the central electrode of FIG. 1, absorbs a large amount of heat from the combustion chamber and can remove the heat absorbed via a heat-conductive axial connection into the inside of the spark plug. For this purpose, the preferred erosion resistor must have sufficient thermal conductivity. This requirement can be met by using aluminum nitrate (ALN) as the ceramic support of the resistor.

Figure 4:
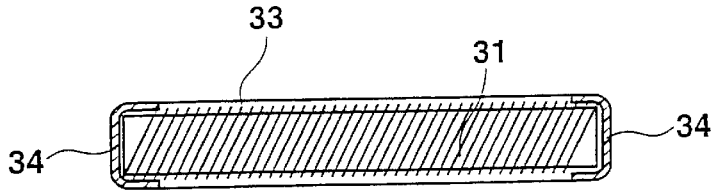
FIG. 4 shows a filament-like thin-layer resistor.

FIG. 4 shows a possible configuration of the refractory resistor as a thin-layer resistor. Cylindrical ceramic support 31 is initially coated, for example, by vacuum sputtering. Subsequently, structuring takes place via the evaporation of the thin layer using a laser. This embodiment is also coated with a refractory glass layer 33 to protect it against oxidation. The end faces of the cylindrical ceramic support are also provided with refractory metal caps 34, which ensure electrical contact.

Figure 5:
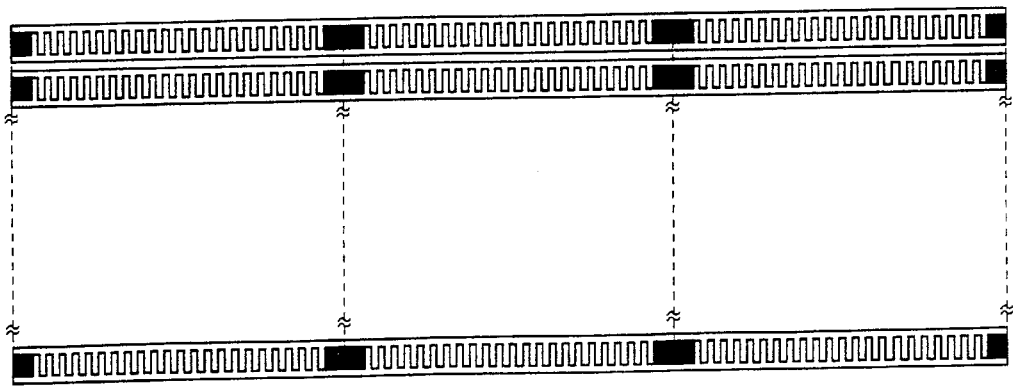
FIG. 5 shows a planar type erosion resistor.

FIG. 5 shows one embodiment of the thin layer resistor, which can also be manufactured using planar technology. In this planar technology embodiment, a ceramic substrate plate is initially coated on its entire surface by vapor deposition or sputtering. Subsequently the coil structures are applied preferably using photolithographic technology. The required glass coating and contact metal plating can be performed using thick layer technology, so that ultimately the resistors can be cut up without considerable expense.

The spark plug sections illustrated in FIGS. 1 and 2 show the built-in refractory erosion resistors. The externally manufactured refractory erosion resistor 13 is contacted with terminal stud 12 using glass 14 and sealed.

The above-described spark plugs are slide discharge spark plugs, in which the ignition spark partially glides over the insulator. Pitting by the electric spark may occur on the slide path, which may result in ignition failure, since the energy transfer to the combustible mixture is reduced if the spark burns deep in a pit. Since such deep pitting may result in permanent damage to the spark plug, the object is to avoid such pitting. The critical phase for pitting is the sparkover phase. During that time, which spans only a few nanoseconds, the entire converted energy is located on the ceramic surface. This energy results in part from the spark plug capacitance, which cannot discharge via an interference suppressor resistor and for today's spark plugs it can be approximately described by the cylinder capacitance $C_Z$, which is formed between the internal conductor and the external conductor, but is only effective over length l between the end of the erosion resistor and the central electrode. FIGS. 1 and 2 show this distance 1.

Energy E stored in cylinder capacitance $C_Z$ is $$E=1/2\times C_Z\times U_Z^2,$$

where $U_Z$ is the ignition voltage of the spark plug. This results in the danger of pitting being the greater the higher the ignition voltages. As is known, in order to avoid pitting, the sparkover energy can be reduced by reducing the relevant capacitance $C_Z$. This has previously been accomplished by reducing length 1, the distance between the end of the erosion resistor and the central electrode. Furthermore, the diameter of the internal conductor can be reduced in order to reduce the cylinder capacitance.

Using the embodiments according to the present invention, the relevant cylinder capacitance is reduced, since the relevant length l can be considerably shortened due to the novel design of the erosion resistor.

Erosion does not occur until the ceramic slide path is not only heated up, but melted by the spark, i.e., an energy threshold has been exceeded; therefore, energy reduction according to the present invention means that the spark no longer causes pitting, since the critical threshold can no longer be exceeded.

Compared to conventional erosion resistors made of glass, wound wire resistors or filament-like thin layer metal resistors have a significantly inductive resistivity component, which has a positive effect on interference suppression for the erosion resistor. Therefore, when using such preferred erosion resistors in the spark plugs, no interference suppressors are needed in the spark plug.

The cylinder capacitance is usually calculated as follows:

$$cz = \frac{2\pi\varepsilon_0\varepsilon_r}{\ln\varnothing_a/\varnothing_i}l$$

where $\epsilon_0$=dielectric constant $\epsilon_r$=relative dielectric constant l=cylinder length $\varnothing_a$=outer diameter $\varnothing_i$=inner diameter

What is claimed is:

1. A spark plug, comprising:

a tubular metallic housing;

an insulator imbedded in the housing;

a contact stud;

a central electrode; and a rod-shaped internal conductor arrangement situated in the insulator, the arrangement including a conductive contact and including an erosion resistor having meandering conductive windings, the conductive contact and the erosion resistor electrically connecting the contact stud to the central electrode;

wherein the refractory erosion resistor includes a coiled thin layer resistor on a ceramic substrate.

2. The spark plug according to claim 1, wherein the coiled thin-layer resistor is made using planar technology.

3. A spark plug, comprising:

a tubular metallic housing;

an insulator imbedded in the housing;

a contact stud;

a central electrode; and a rod-shaped internal conductor arrangement situated in the insulator, the arrangement including a conductive contact and including an erosion resistor having coiled conductive windings, the conductive contact and the erosion resistor electrically connecting the contact stud to the central electrode;

wherein the erosion resistor includes a thin-layer resistor on a ceramic substrate.

4. The spark plug according to claim 3, wherein the thin-layer resistor is made using planar technology.

* * * * *

UNITED STATES PATENT AND TRADEMARK OFFICE

CERTIFICATE OF CORRECTION

PATENT NO. : 6,559,578 B1
DATED : May 6, 2003
INVENTOR(S) : Werner Herden et al.

It is certified that error appears in the above-identified patent and that said Letters Patent is hereby corrected as shown below:

Title page, Item [54], column 1, line 1,
Item [54], Title, change the title from "SPARK PLUG FOR AN INTERNAL COMBUSTION ENGINE" to -- SPARK PLUG HAVING COILED THIN-LAYER RESISTOR FOR AN INTERNAL COMBUSTION ENGINE --

Column 1,
Line 27, change "spark plug" to -- spark plug capacitance --
Line 42, before "German Patent No.", please add -- The basic design of a spark plug is sufficiently known from --

Signed and Sealed this

Sixth Day of July, 2004

JON W. DUDAS
*Acting Director of the United States Patent and Trademark Office*